US005152838A

United States Patent [19]

Kisler

[11] Patent Number: 5,152,838

[45] Date of Patent: Oct. 6, 1992

[54] COATING FLUID DRYING APPARATUS

[75] Inventor: Semyon Kisler, Needham, Mass.

[73] Assignee: Polaroid Corporation, Cambridge, Mass.

[21] Appl. No.: 297,848

[22] Filed: Jan. 17, 1989

[51] Int. Cl.[5] ..... B05C 11/06

[52] U.S. Cl. ..... 118/68; 34/1 R; 118/639; 427/535; 427/379

[58] Field of Search ..... 118/66-68, 118/639; 427/38, 39, 45.1, 372.2, 379; 34/1

[56] References Cited

U.S. PATENT DOCUMENTS

| | | | |
|---|---|---|---|
| 2,662,302 | 12/1953 | Cunningham et al. | 34/1 |
| 3,401,463 | 9/1968 | Doane, Jr. | 34/1 |
| 3,633,282 | 1/1972 | Candor et al. | 34/1 |
| 3,760,152 | 9/1973 | Saito et al. | 219/384 |
| 3,765,099 | 10/1973 | Kohlmannsperger | 34/1 |
| 3,887,720 | 6/1975 | Jackson | 118/68 X |
| 4,359,826 | 11/1982 | Rounsley | 34/1 |
| 4,363,070 | 12/1982 | Kisler | 361/212 |
| 4,402,035 | 8/1983 | Kisler | 361/213 |
| 4,457,256 | 7/1984 | Kisler et al. | 118/621 |
| 4,489,672 | 12/1984 | Kisler | 118/620 |
| 4,513,683 | 4/1985 | Kisler | 118/620 |
| 4,570,566 | 2/1986 | Long | 118/67 X |

*Primary Examiner*—Richard L. Chiesa
*Attorney, Agent, or Firm*—John J. Kelleher

[57] ABSTRACT

An improved drying system for drying coating fluids is provided by which conventional drying times are greatly reduced by subjecting the coating on a moving support web to a corona discharge in a manner creating a drying current flow along the length of the coating. Further reductions in drying time are realized by subjecting the coating to an intense electrostatic field, air streams and/or heat from a heated platen.

15 Claims, 3 Drawing Sheets

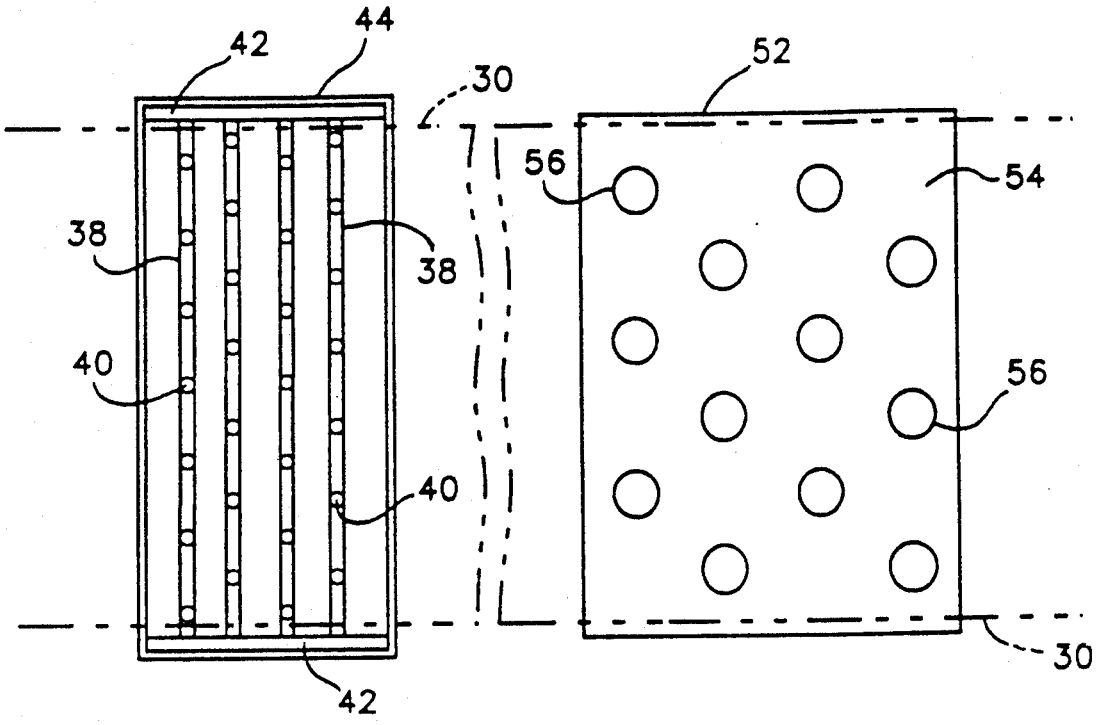
FIG. 2
FIG. 3
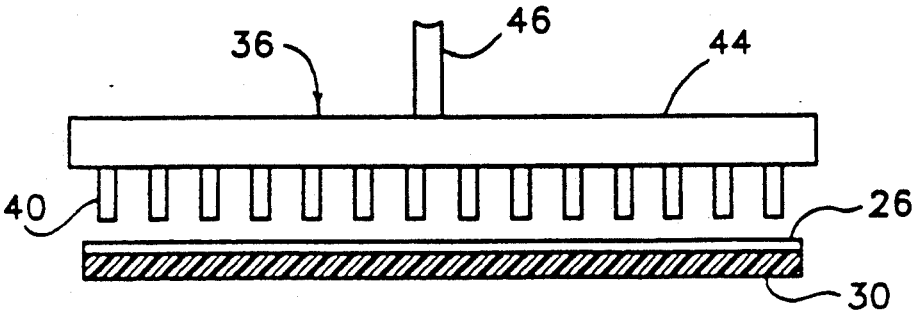

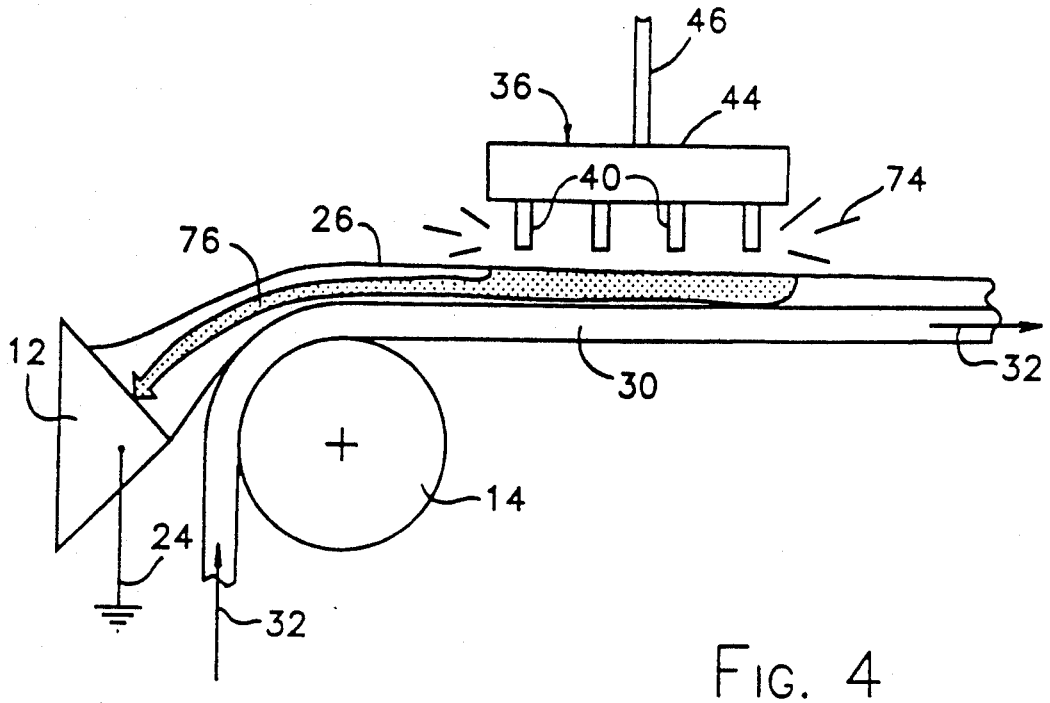
FIG. 4
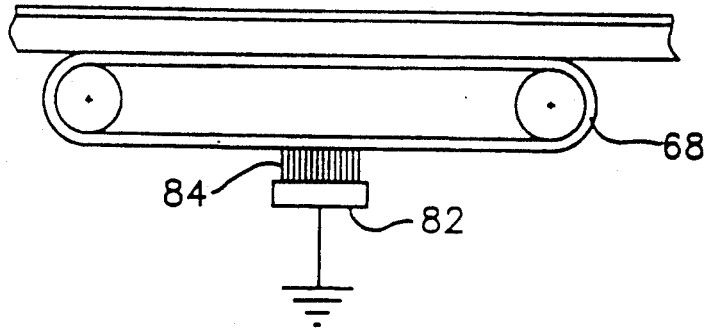
FIG. 6
FIG. 7
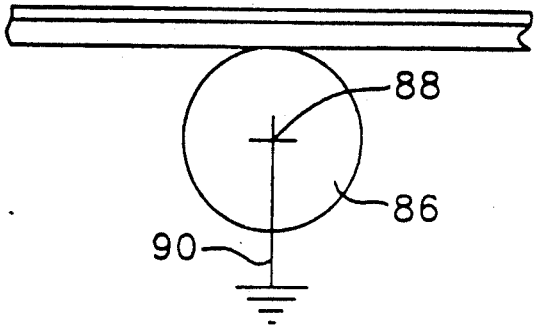

COATING FLUID DRYING APPARATUS

BACKGROUND OF THE INVENTION

This invention relates to a method and apparatus for drying coating fluids and, more particularly, it concerns an improved drying arrangement including both corona and electrostatic drying units for reducing coating fluid drying time.

Coated products formed by applying a coating to a moving continuous web are well known in the photographic industry. Two of the major factors limiting maximum production rates and increasing manufacturing costs of such coated products are drying time and the application of multiple coatings to a single support web. A typical photographic coated product manufacturing facility includes large drying ovens and numerous coating runs. The large drying ovens provide for uniform drying and produce high quality photographic products. However, such ovens are costly to build and operate. The numerous coating runs provide for the sequential application of superposed coatings, especially solvent or oil based and aqueous coatings, since each coating must be dried before application of the next coating. Again, although the numerous coating runs produce quality multicoated products, such a multiplicity of equipment is costly to construct and energy and time consuming in operation.

Further, it is known to use corona generating or electrostatic field producing systems to assist in the application of a uniform coating on a charge-retaining base material of a photographic product. The uniformity of the coating enhances drying of the coating by allowing the drying oven to be set at an optimum temperature and, as such, reduces drying time. Examples of such systems are disclosed in commonly assigned U.S. Pat. Nos. 4,489,672 and 4,513,683 issued to Semyon Kisler and 4,457,256 issued to Semyon Kisler et al. Such coating systems are combined with the above-mentioned large drying ovens and coating runs to produce quality photographic coated products at optimum drying temperatures. Nevertheless, drying time still remains as one of the major factors limiting maximum production rates of such coated products.

One method for reducing the drying time of a coated photographic product described in U.S. Pat. No. 2,662,302 issued to Jack B. Cunningham et al involves the use of an ultra high frequency cavity resonator for dielectric heating and drying a dielectric photographic emulsion on a cellulose acetate, cellulose nitrate or paper base during photographic film manufacture. The photographic stock is continuously fed through the cavity resonator on a conveyor belt at a speed which allows the film to rapidly increase in temperature from about 32° to 165° F. as it passes through a concentrated high intensity field located in the center of the resonator and directed perpendicular to the emulsion surface. In order to subject the emulsion to a large increase in temperature without raising the emulsion temperature above a maximum of 165° F., the cavity resonator is placed in a refrigerated room or housing maintained at 32° F. so that the temperature of the film as it enters the resonator is about 32° F. Thus, the dielectric heating system of Cunningham et al requires the use of not only a high frequency generator and refrigeration equipment, but also requires that the film be of a type not adversely affected by freezing temperatures.

U.S. Pat. No. 3,401,463 issued to Foster P. Doane, Jr. discloses a high speed paper making system which includes a high frequency dielectric heating unit for raising the temperature of water in a wet paper web prior to the web passing between a pair of press rolls. The dielectric heating unit is driven in a voltage range of 5 to 25 KV at a frequency between 2 to 90 megacycles to raise the water temperature to a maximum of 212° F. Doane is concerned with raising the temperature of the water in the web without actually evaporating the water from the web and relies upon couch and press rolls to remove the dielectrically heated moisture from the paper web. Such a system is not conducive to the production of coated photographic products since physical contact with a wet coating and high temperatures typically have an adverse effect on the uniformity and characteristics of the coating.

Paper web drying systems including electrostatic drying arrangements are disclosed, for example, in U.S. Pat. Nos. 3,633,282 issued to Robert R. Candor et al and 4,359,826 issued to Robert R. Rounsley. The Candor et al patent discloses a paper web liquid removing apparatus including a plurality of opposing small and large electrodes used to produce nonuniform electrostatic fields oriented substantially perpendicular to the web. The electrostatic fields attract or drive moisture from the porous wet web in the direction of increasing intensity of the field. The Rounsley patent discloses a paper web drying system in which a porous wet web is subjected to evaporation energy in the form of heat produced by, for example, infrared energy, heated air, a heated drum, or radiant burners and enhancing the evaporation using electrostatic fields.

The use of corona devices for removing excess fluids is known. For example, U.S. Pat. No. 3,765,099 issued to Josef Kohlmannsperger discloses a method and apparatus for drying the wet surface of a photoelectric or dielectric copy carrier by using a gas-ion-air stream emanating from a set of transverse electrodes to push the liquid off the copy carrier during movement of the electrodes over the carrier. The air stream is developed by placing the wet copy carrier on a conductive support plate and providing a potential difference on the order of 4 to 8 KV between the electrodes and the conductive support plate. This rather large potential difference creates a relatively narrow and intense electric field between the electrodes and the underlying support plate and which passes through a relatively narrow transverse section of the wet copy carrier. The intensity of the electric field at the points of the electrodes causes ionization of the surrounding air and produces high speed gas ions directed toward the wet copy carrier. These moving gas ions form an air stream which drives the liquid off the wet copy carrier during movement of the electrodes over the length of the copy carrier.

U.S. Pat. No. 3,760,152 issued to Takashi Saito et al discloses a corona discharge device for removing excess dielectric liquid from a photosensitive or transfer sheet during an electrophotographic copy process. The corona discharge causes a narrow transverse strip of the dielectric liquid layer to be electrically charged progressively from the surface closest to the corona discharge device to the opposite surface of the liquid layer. The progressive charge creates a concave recess and self-squeezing effect in the liquid layer. As a result, excess liquid gathers in a bulged body on the sheet on the upstream side of the corona discharge. The corona discharge device includes a corona discharging electrode in a grounded shield with a narrow discharge opening such that only a very narrow transverse strip of the dielectric liquid surface is exposed to the corona discharge.

In light of the above, there is a need for an improved drying system for reducing coating-fluid drying time while at the same time eliminating the need for large energy and time consuming drying ovens and multiple coating runs, and which does not deleteriously affect the uniformity or quality of the coating.

SUMMARY OF THE INVENTION

In accordance with the present invention, an improved drying system and method for drying coating fluids is provided by which conventional drying times are greatly reduced by subjecting the coating to a corona discharge in a manner creating a drying current flow along the length of the coating. Further reductions in drying time are realized by subjecting the coating to an intense electrostatic field.

In the practice of the present invention, a corona unit having at least one AC driven corona discharge head is located in relation to a grounded coating applicator such that a drying current flows in the coating between the corona discharge head and the applicator. In a preferred embodiment, corona drying is enhanced by use of a pair of closely spaced corona discharge heads and a center tap transformer such that a drying current flows along the length of the wet coating between the corona heads and the grounded applicator throughout each AC drive cycle. The fluid surface effect and the drying current produced by the corona discharge of the corona unit rapidly dry the coating.

The corona drying unit is followed downstream with electrostatic and air drying units. The electrostatic drying unit includes a conductive brush-type electrode and a preferably floating or electrically isolated backup belt or roller to provide an intense electrostatic field therebetween. Air drying units including ducts for directing a drying air stream over the coating are located on opposite sides of the electrostatic drying unit. The web is advanced over a heated support to further reduce the drying time.

Among the objects of the present invention are, therefore, the provision of a coating fluid drying system and method which greatly reduces drying time and in so doing eliminates the need for large drying ovens and permits the sequential application of superposed coatings along a single coating run. Another object of the invention is to provide such a method and apparatus by which coatings are rapidly dried while at the same time maintaining the uniformity and characteristics of the coating necessary for quality photographic products.

Other objects and further scope of applicability of the present invention will become apparent from the detailed description to follow taken in conjunction with the accompanying drawings in which like parts are designated by like reference numerals.

BRIEF DESCRIPTION OF THE DRAWINGS

FIG. 2 is an enlarged fragmentary bottom elevation illustrating the corona unit and one of the air drying units of FIG. 1;

FIG. 3 is an enlarged fragmentary cross section on line 3—3 of FIG. 1;

FIG. 4 is an enlarged fragmentary schematic side elevation of the corona drying unit of FIG. 1 in operation;

FIG. 6 is a schematic side elevation illustrating an alternative grounded backup for the electrostatic unit of FIG. 1; and FIG. 7 is a schematic side elevation representing yet another alternative grounded backup for the electrostatic drying unit of FIG. 1.

DESCRIPTION OF THE PREFERRED EMBODIMENT

Figure 1:
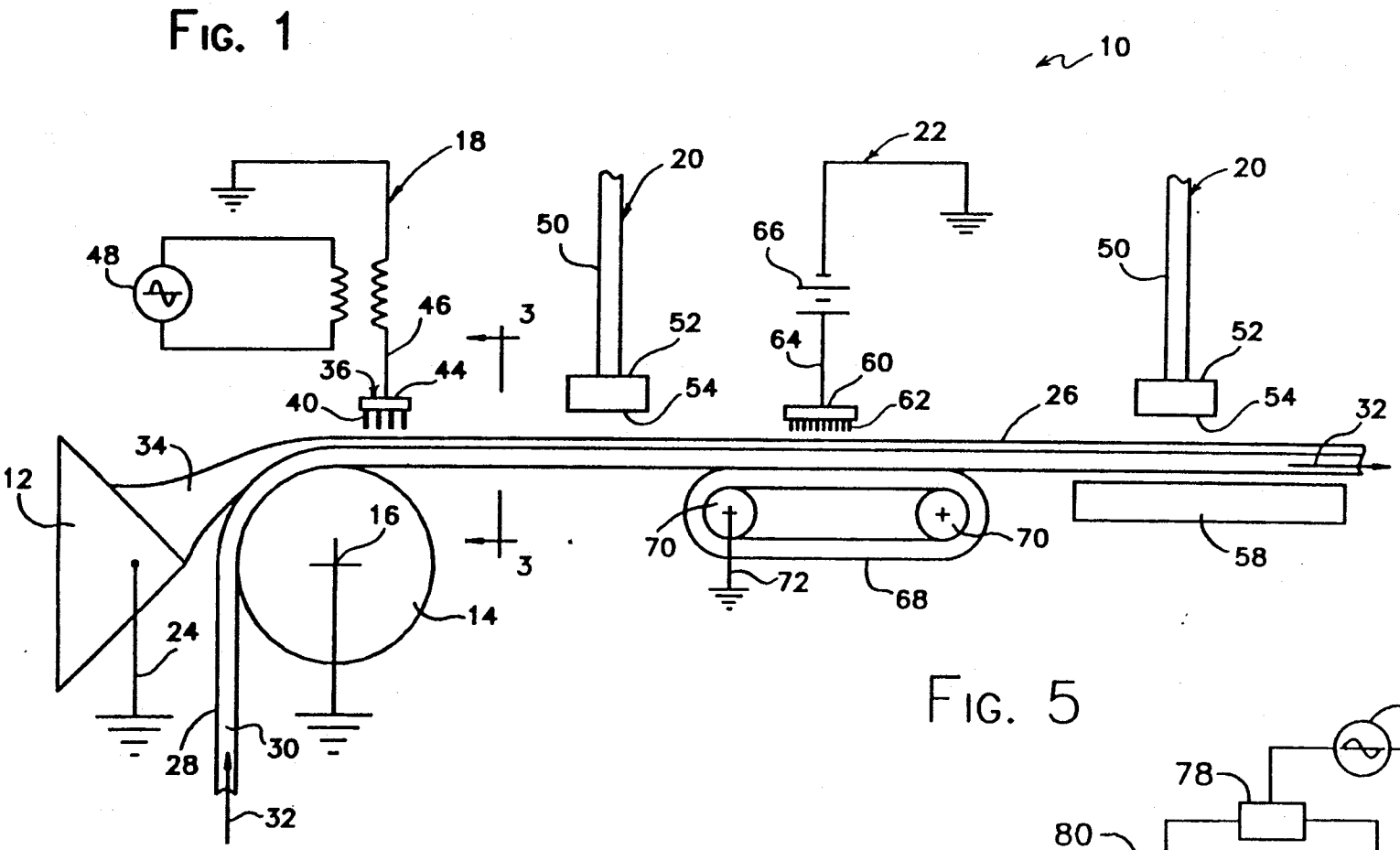
FIG. 1 is a schematic side elevation representing the drying system of the present invention.

In FIG. 1 of the drawings, a corona and electrostatic drying system in accordance with the present invention is designated generally by the reference number 10 and shown to include a conventional coating applicator 12 fixedly positioned opposite a conventional grounded cylindrical backup roller 14 mounted for rotation about an axis 16. Downstream of the applicator 12, the drying system 10 further includes a corona unit 18, air drying units 20, and an electrostatic unit 22 interposed between the air drying units 20. The particulars of the conventional coating applicator 12 do not form part of the present invention beyond the criteria that the applicator 12 be grounded at 24. Typically, such an applicator 12 is maintained at or near ground potential through a coating fluid supply conduit (not shown). The applicator 12 applies a wet coating 26 to the upper surface 28 of a conventional insulative or dielectric web 30 as the web passes between the applicator 12 and the roller 14 in the direction of web travel 32 under the influence of a web drive arrangement (not shown).

The applicator 12 is located a sufficient distance away from the backup roller 14 to provide for the formation of a coating fluid bead 34 and to accommodate, for example, web splices. Generally, the speed at which the web 30 moves past the applicator 12, the flow characteristics of the particular coating fluid, and the gap between the applicator 12 and web surface 28 determine the thickness of the wet coating 26. Further information regarding the application of the coating fluid to the web surface can be had by reference to the above-mentioned commonly assigned U.S. Pat. Nos. 4,489,672, 4,457,256 and 4,513,683 hereby incorporated by reference.

As shown in FIGS. 1-3 of the drawings, corona unit 18 includes a corona discharge head 36 supporting a plurality of elongated linear arrays or rows 38 of needle electrodes 40 transverse to the web 30. The ends of each of the linear arrays 38 are mounted on respective insulative blocks 42 within a rectangular shield or hood 44 with each array 38 spaced, for example, approximately ¼ of an inch from the next array along the direction of web travel. The needle electrodes 40 of each array 38 are offset transversely of the web 30, for example, approximately ¼ of an inch with respect to the needle electrodes of each adjacent array. Each of the linear arrays 38 is connected to a common drive lead 46 which is in turn connected to a high voltage power supply 48, preferably AC, although DC will also operate in this system. The voltage provided by the supply 48 is sufficient to create a corona discharge, i.e., a bluish-purple glow, on the surface of and adjacent to each of the electrodes 40 due to ionization of the surrounding air.

Each of the air drying units 20 (FIGS. 1 and 2) includes a drying air supply duct 50 which receives heated and/or dry air under pressure from a conventional furnace or blower unit (not shown) and terminates in a rectangular chamber 52 having a lower surface 54 adjacent to the coating 26. Each of the chambers 52 traverses the full width of the web 30 and extends for a short distance along the length of the web 30. The lower surface 54 of each of the chambers 52 includes a plurality of circular openings 56 which provide for an even distribution of drying air across the upper surface of the coating 26 opposite the chamber 52.

As shown in FIG. 1 of the drawings, a heated platen or support 58 is fixedly mounted parallel and adjacent to the lower surface of the web 30 opposite one of the air drying units 20. The heated platen 58 is maintained at a temperature, for example, of 100° F. by a conventional heat source such as a resistive coil (not shown). The heated platen 58 enhances drying of the coating 26 by raising the temperature of the web 30 as it advances over the platen 58.

The electrostatic unit 22 includes a conductive bristle-brush electrode 60 traversing the web 30 and having a multiplicity of conductive bristles or filaments 62. Each of the bristles 62 is connected to a common lead 64 in a conventional manner, for example, as described in detail in commonly assigned U.S. Pat. Nos. 4,363,070 and 4,402,035 issued to Semyon Kisler and hereby incorporated by reference. The lead 64 is connected to a high voltage DC power supply 66.

Opposite the brush electrode 60 and in a position to support web 30 is a conductive belt 68 trained about a pair of end rollers 70. At least one of the end rollers is conductive and coupled to the supply 66 through a path 72 so that the conductive belt 68 is electrically isolated or floating with respect to the overall system ground potential. The brush 62 and conductive belt 68 combination provide electrostatic drying rather than the current drying described with respect to the applicator 12 and corona unit 18. Where the web coating is sufficiently non-conductive or dielectric, a grounded belt or roller arrangement would suffice since little current will flow in the coating. However, under conditions where the coating is relatively conductive, even in its dried state or not yet dry enough to render it sufficiently dielectric, an electrically isolated or floating back plate is preferred. The latter can be provided, for example, by employing an isolation transfer at the supply 66. The floating back plate system insures that no current will flow in the coating to the common ground of the apparatus and that any current that might flow is directly between the brush 62 and the belt 68 such that the type of drying at this point remains electrostatic.

In this manner, an intense electrostatic field is produced between the free ends of the bristles 62 of the brush electrode 60 and the conductive belt 68. The density of bristles per square inch, the number of square inches of brush filaments, and the physical dimension of the particular brush 60 are determined by factors such as the speed of web travel, the type of web material, the particular coating composition, and the gap between the free ends of the bristles 62 and the conductive belt 68. Although only a single electrostatic unit 22 is shown in FIG. 1, it is to be understood that additional electrostatic units can be located downstream of the unit 22 to compensate for a thick web coating or high web travel rate.

With additional reference to FIG. 4 of the drawings, when the high voltage, for example, 10 KVAC, of the power supply 48 reaches the electrodes 40 of the corona discharge head 36, a corona discharge schematically depicted at 74 is produced on and around the electrodes 40 due to ionization of the surrounding air. The corona discharge head 36 is located a relatively short distance downstream from the grounded applicator 12 so that the still wet coating underlying the corona head 36 acts as a conductive path between the electrodes 40 and the applicator 12. As such, the backup roller 14 need not be grounded. Further, the free ends of the electrodes 40 are positioned a short distance, for example, ⅛ of an inch, from the coating 26 so that the corona discharge 72 not only enhances drying of the coating 26 by effecting the surface of the coating, for example, by subjecting the upper surface of the coating to an air stream of moving gas ions, but also provides a drying current flow 76 along the length of the coating 26 between the electrodes 40 and the applicator 12. This drying current flow 76 greatly reduces the drying time of the coating 26, e.g., a 6–10 times reduction was realized in an experiment using an approximately 10 KV power supply and an electrode-to-coating spacing of approximately ⅛ of an inch, with the magnitude of the reduction being dependent upon the characteristics of the particular coating fluid involved.

Figure 5:
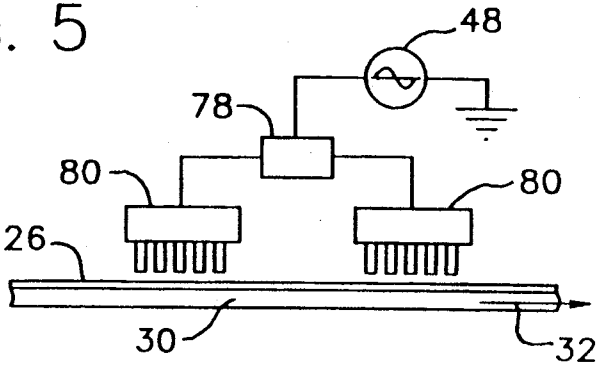
FIG. 5 is a schematic side elevation representing an alternative corona unit of the present invention.

In a preferred embodiment shown in FIG. 5 of the drawings, the corona unit 18 has been modified to incorporate a center tap transformer 78 to drive a pair of like corona discharge heads (each identical to the head 36) traversing the web 30 and being spaced apart in the direction of web travel. Each of the corona heads 80 is driven at a somewhat different phase, and preferably on alternate phase, i.e., 180° out of phase, such that a drying current flow is produced along the length of the web coating 26 during corona discharge of the corona heads 80 throughout each full AC drive cycle. This provides more efficient drying than a single supply head as previously described. In an experimental arrangement, a 12 KV center tap transformer was used to drive a pair of spaced 6 KVAC corona heads with alternating polarity. Thus, by using a pair of corona heads drying time is further reduced.

In FIG. 6 of the drawings, the conductive belt arrangement of the electrostatic unit 22 of FIG. 1 is modified so that the conductive backup belt 68 is maintained at or near ground potential by a conductive brush 82 having a plurality of conductive bristles 84. The brush 82 traverses the belt 68 and is positioned so that the free ends of the bristles 84 are adjacent to the outer surface of the belt. This arrangement facilitates the use of a belt 68 having only a conductive outer surface.

In the circumstance where a slight curvature or turning of the web 30 would be advantageous, the conductive belt arrangement of the electrostatic unit 22 is replaced as shown in FIG. 7 with a cylindrical backup roller 86 mounted for rotation about an axis 88 and grounded at 90. In an experimental electrostatic unit, an NCR coating was dried rapidly by an electrostatic field generated by connecting an 18 KVDC power supply to a conductive bristle brush with the free ends of the bristles spaced about 2 cm from a conductive backup roller.

With reference again to FIG. 1 of the drawings, it is contemplated that the drying system 10 provides for such rapid drying of the coating 26, that a second coating can be superposed atop the dry or nearly dry coating 26 following the downstream air drying unit 20. Such a second coating can be applied using a drying system (not shown) having the same construction as the drying system 10. In such a manner, numerous coatings can be superposed atop the same web along a single coating run.

Thus, it will be appreciated that as a result of the present invention, a highly effective coating fluid drying apparatus and method is provided by which the principal object and others are completely fulfilled. It is contemplated and will be apparent to those skilled in the art from the foregoing description and accompanying drawing illustrations that variations and/or modifications of the disclosed embodiment may be made without departure from the invention. Accordingly, it is expressly intended that the foregoing description and accompanying drawings are illustrative of a preferred embodiment only, not limiting, and that the true spirit and scope of the present invention be determined by reference to the appended claims.

What is claimed is:

1. Apparatus for drying coating fluids, comprising:

a coating applicator for applying a wet coating to one surface of a moving support; and a corona drying means including at least one corona unit having corona discharge producing electrode means located adjacent to the wet coating for producing a drying current flow along the length of the wet coating.

2. The drying apparatus recited in claim 1, wherein said coating applicator is grounded.

3. The drying apparatus recited in claim 2, wherein said drying current flow runs from said electrode means to said grounded applicator.

4. The drying apparatus recited in claim 1, wherein said corona unit includes an AC power source.

5. The drying apparatus recited in claim 4, wherein said electrode means includes a plurality of rows of needle electrodes.

6. The drying apparatus recited in claim 5, wherein said electrode means has a number of rows of needle electrodes with each row spaced from the next row along the direction of support travel.

7. The drying apparatus recited in claim 6, wherein the needle electrodes of each said row are spaced from the other transversely of the support.

8. The drying apparatus recited in claim 4, wherein said corona unit includes a center tap transformer and a pair of corona discharge heads spaced apart along the direction of support travel and driven with alternating polarity such that the drying current flow in the wet coating is substantially continuous throughout each full AC cycle.

9. The apparatus recited in claim 1, further comprising:

at least one electrostatic drying means located downstream of said corona drying means and including a conductive electrode means and an opposed conductive backup means.

10. The drying apparatus recited in claim 9, wherein said backup means is a conductive roller.

11. The drying apparatus recited in claim 9, wherein said backup means is a conductive belt arrangement extending in the direction of support movement and including a conductive belt and a pair of end rollers.

12. The drying apparatus recited in claim 11, wherein at least one of said rollers is grounded.

13. The drying apparatus recited in claim 11, wherein said grounded belt arrangement further includes a conductive grounded brush for grounding the conductive belt.

14. The drying apparatus recited in claim 9, further comprising:

at least one air drying means downstream of said corona drying means and including means for directing a drying air stream against the coating.

15. The drying apparatus of claim 14, wherein said apparatus includes a plurality of air drying means with the electrostatic drying means interposed therebetween.

* * * * *